US005314111A

United States Patent [19]

Takaku et al.

[11] Patent Number: 5,314,111

[45] Date of Patent: May 24, 1994

[54] PACKAGING BOX AND SHEET FOR PACKAGING BOX

[75] Inventors: Yutaka Takaku; Toshihiro Suzuki; Jiro Wake; Kanji Motegi; Masakatu Yanazawa, all of Fujisawa, Japan

[73] Assignee: Kabushiki Kaisha Kobe Seiko Sho, Kobe, Japan

[21] Appl. No.: 945,884

[22] Filed: Sep. 17, 1992

[30] Foreign Application Priority Data

| | | | |
|---|---|---|---|
| Sep. 28, 1991 | [JP] | Japan | 3-277140 |
| Jan. 21, 1992 | [JP] | Japan | 4-008768 |
| Mar. 30, 1992 | [JP] | Japan | 4-074751 |
| Mar. 30, 1992 | [JP] | Japan | 4-074758 |
| Mar. 30, 1992 | [JP] | Japan | 4-103228 |
| May 12, 1992 | [JP] | Japan | 4-123886 |
| May 12, 1992 | [JP] | Japan | 4-123887 |

[51] Int. Cl.[5] ..... B65D 85/67

[52] U.S. Cl. ..... 229/110; 206/395; 229/8

[58] Field of Search ..... 229/8, 110, 117.09, 229/117.12; 206/303, 391, 392, 395, 446

[56] References Cited

U.S. PATENT DOCUMENTS

| | | | |
|---|---|---|---|
| 2,067,998 | 1/1937 | Williamson | 229/8 |
| 2,884,181 | 4/1959 | McCormick | 229/8 |
| 2,966,293 | 12/1960 | Goldsholl | 229/8 |
| 3,017,021 | 1/1962 | Ruiz | 206/395 |
| 3,040,958 | 6/1962 | Hagan . | |
| 3,491,876 | 1/1970 | Zecchin | 206/395 |
| 3,944,072 | 3/1976 | Budington et al. | 206/395 |
| 4,124,160 | 11/1978 | Meyers et al. | 229/8 |
| 4,164,316 | 8/1979 | Gooding . | |
| 4,172,549 | 10/1979 | Yoshida | 229/8 |
| 4,432,489 | 2/1984 | Cote | 229/8 |

FOREIGN PATENT DOCUMENTS

| | | | |
|---|---|---|---|
| 3149506 | 6/1983 | Fed. Rep. of Germany . | |
| 8707986 | 10/1987 | Fed. Rep. of Germany . | |
| 531694 | 8/1955 | Italy | 229/8 |
| 3-14449 | 1/1991 | Japan . | |

*Primary Examiner*—Gary E. Elkins

*Attorney, Agent, or Firm*—Oblon, Spivak, McClelland, Maier & Neustadt

[57] ABSTRACT

A rectangular-parallelepiped packaging box having three folding lines, in each of at least one of four corners of top and bottom faces of the box, interconnecting three ridgelines which meet at each of the four corners. At these corners are formed concaved sections by folding pointed corners inward along the folding lines. A worker, therefore, can easily insert the hands into the concaved sections and lift the box. During transport, the worker grips the box firmly with the fingers put in the concaved sections, and therefore there will not occur such a hazard that the box slips off the hands and down.

10 Claims, 9 Drawing Sheets

PACKAGING BOX AND SHEET FOR PACKAGING BOX

BACKGROUND OF THE INVENTION

1. Field of the Invention

The present invention relates to a packaging box and a sheet for the packaging box to be used for packing a wire for welding and other and, more particularly, to a packaging box and a sheet for the packaging box that have been improved in portability.

2. Description of the Prior Art

The wire for welding is usually wound into a form of a cylinder around a coil core. During a period of storage in a warehouse for products after delivery from a manufacturing factory, shipping, transport, and delivery to an end user, the welding wire is packaged in a rectangular parallelepiped corrugated fiberboard box. That is to say, the wire for welding thus coiled on the core is carried in the rectangular parallelepiped corrugated fiberboard box.

This wire for welding, however, is very heavy, weighing for example 20 kg a roll. This heavy material is packaged in for example a 280 mm wide and 110 mm high corrugated fiberboard box.

A worker, when carrying a welding wire, first tilts a corrugated fiberboard box containing the welding wire, inserts one hand between the bottom of one edge of the box and the floor and then the other hand between the bottom of the other edge of the box and the floor. After the insertion of the hands, the worker lifts and carries the box to a specific position. However, it is not easy to lift such a heavy object with the hands and feet set in unstable and uncomfortable positions, and the transportation of the object is hard work. It is possible that there occurs a lifting-associated injury such as a pain in the back, or a transport-associated accident such as the drop of the object off the hands onto his foot. Particularly since the worker usually wears gloves, the corrugated fiberboard box is likely to slip off the hands if handled carelessly, giving an injury to his foot.

There has been proposed in Japanese Unexamined Patent Publication No. Hei 3-14449 a packaging box having concaved sections provided each in the central part of a ridgeline by providing a pair of folding lines in parallel with one ridgeline at the central part of this ridgeline and also providing a cutting line connecting the ends of each folding line to each other. The worker can carry the box with the hands reaching and gripping the box at these concaved sections. This type of box, however, has such a disadvantage as low strength because these concaved sections are formed by cutting part of the box. Furthermore the box with these concaved sections has holes thereat, resulting in defective packaging.

SUMMARY OF THE INVENTION

The present invention alleviates the above and other disadvantages of prior arts, and has as its object the provision of a corrugated fiberboard packaging box containing a heavy object which can be lifted with ease without such a hazard as falling from the hands of a worker.

The packaging box of the present invention is made up substantially of six sides, having at least one concaved section provided at a corner where three ridgelines meet; the concaved section is formed by folding inward at three folding lines connecting the aforesaid ridgelines to one another.

The packaging box of the present invention made up substantially of six sides, has three folding lines for connecting the ridgelines in at least one corner section where three ridgelines meet, the folding lines enabling folding the corner section inward.

Furthermore a sheet for the packaging box of the present invention has folding lines for forming a concaved section with three sides around at least one of the six corner sections of the assembled packaging box and the three sides are located concavely of a plane interconnecting three ridgelines forming the corner section to form the concaved section around the corner section.

In the packaging box of the present invention, the concaved sections are formed by three folding lines which connect three ridgelines gathering at each corner section, in at least one of the four corners of a rectangular parallelepiped packaging box. Since this concaved section is formed without any cutting line provided, the box has high strength and accordingly does not deteriorate packaging quality.

Provision of at least one concaved section is satisfactory for the present object. The worker can insert his finger between this one concaved section and a floor face, lift up one side of the box to tilt the box, and lift up the total box by inserting his hand in a clearance generated on the other side. Accordingly, the number of concaved section may be either one of 1, 2, 3 pieces ... and 8 pieces in the present invention.

However, provision of two concaved sections on the bottom face of a packaging box is preferable, because it is possible to lift up the box by inserting fingers in two concaved sections by using both hands simultaneously.

Therefore the worker can lift the box with ease, holding the box at these concaved sections which are easy to grip. As the worker grips these concaved sections during transport, the box will not slip off his hands. That is, the box carrying work can be done easily and safely.

Furthermore, providing the box with the concaved sections on both the top and bottom sides also allows easy lifting and carrying operation if the box is placed upside down on the way of transport.

In the present invention, the box may be provided with folding lines to form concaved sections at corner sections s that the corner sections provided with these folding lines will be pushed inward when necessary to form the concaved sections.

The present invention and its features and advantages will be set forth and become more apparent in the detailed description of the preferred embodiment presented below, when read in connection with the accompanying drawings.

DESCRIPTION OF THE PREFERRED EMBODIMENT

Figure 1:
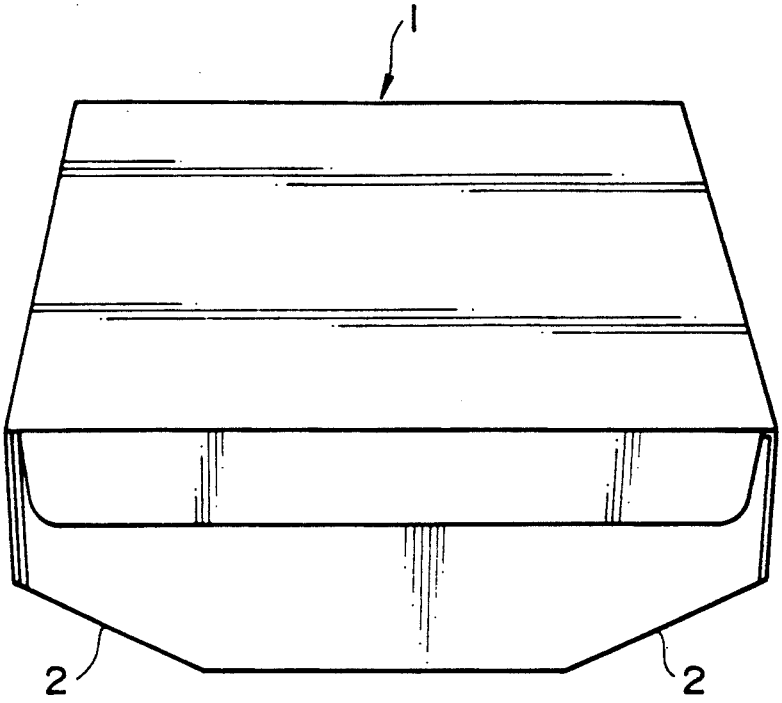
FIG. 1 is a perspective top view of an embodiment of a packaging box according to the present invention.
Figure 2:
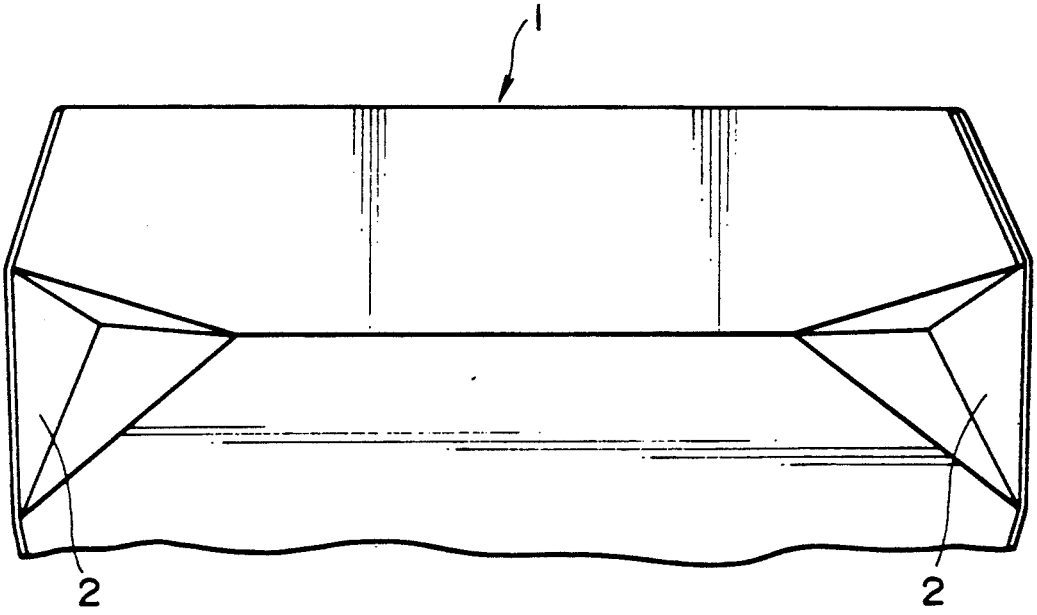
FIG. 2 is a perspective bottom view of the same.
Figure 3:
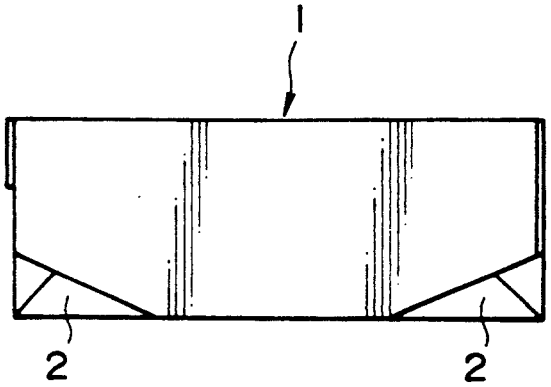
FIG. 3 is a front view of the same.
Figure 4:
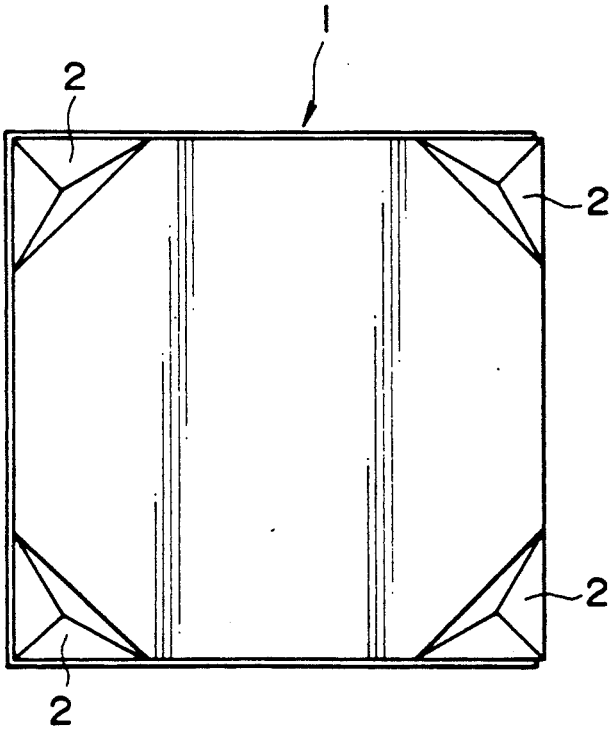
FIG. 4 is a bottom view of the same.
Figure 5:
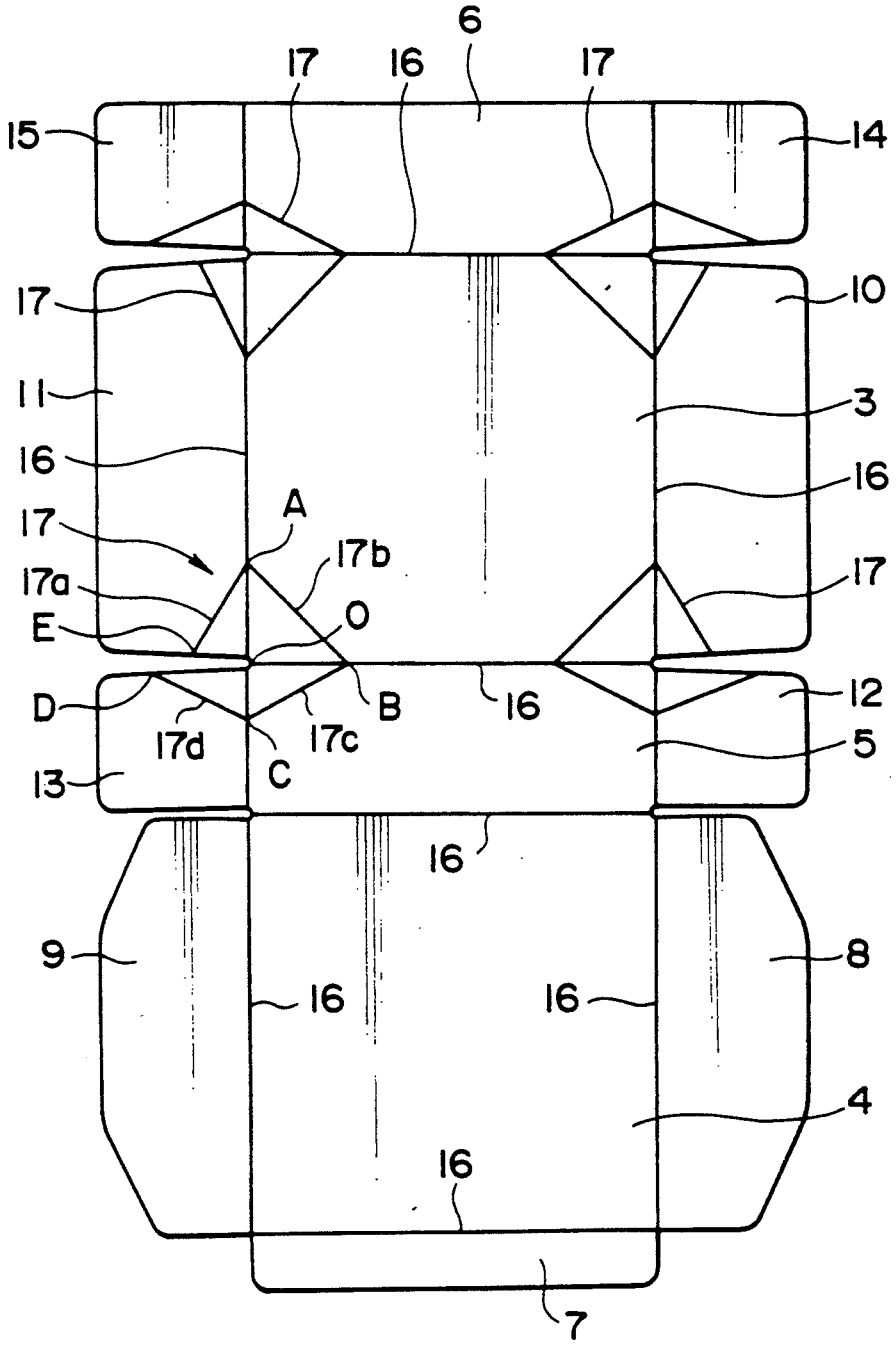
FIG. 5 is a developed view of the same.

FIG. 1 is a perspective view showing an embodiment of a packaging box according to the present invention as viewed from above; FIG. 2 is a perspective view of the same as viewed from below; FIG. 3 is a front view; FIG. 4 is a bottom view; and FIG. 5 is a development. The box 1 is for example a corrugated fiberboard box shaped in a rectangular parallelepiped form. The box is folded inward at four corners of its bottom side, where concaved sections 2 are formed. This concaved section 2 is formed by cutting the corner of the rectangular parallelepiped box 1 obliquely on a plane and removing the cut part into a form of right pyramid, and further depressing the cut part inward into a right pyramid having the obliquely cut plane as a bottom face.

As shown in the developed view of FIG. 5, the contour of the packaging box developed is substantially the same as that of a conventional packaging box. That is, the box has a bottom face 3 which serves as the bottom face of the box, a top face 4 as the top face of the box, a front side 10 at the front, the back side 11 at the back, and side faces 5 and 6 at sides, and further has margins for pasting 7, 8, 9, 12, 13, 14 and 15 necessary for fixing by bonding. Also, the box is provided with folding lines 16 for folding these areas nearly squarely.

These folding lines are the same as conventional ones. Packaging in a conventional rectangular parallelepiped packaging box is accomplished by folding along these folding lines on a box sheet, and fixedly bonding at the areas 7 to 9 and 12 to 15. Therefore these folding lines 16 become the ridgelines of the box.

In the present embodiment, therefore, the box is provided with folding lines 17 at four corners of the bottom face 3. These folding lines 17 consist of a segment 17*a* provided in the front side 10 or the back side 11, a segment 17*b* provided in the bottom face 3, a segment 17*c* provided on the side faces 5 and 6, and a segment 17*d* provided in the margins for pasting 17 to 15. Provided that the length of one side of the top face and bottom face of this packaging box is 250 to 300 mm, the length of the sides OA and OB of each triangular part formed by the folding lines 17*a* to 17*d* and the folding line 16 is for example 60 to 70 mm, the length of the side OC is for example 30 to 40 mm, the length of the side OD is for example 60 to 70 mm, and the length of the side OE is 30 to 40 mm. These folding lines 17 are provided for interconnection of the folding lines 16 in a position where the three folding lines 16 serving as the ridgelines of the box meet.

These folding lines 16 and 17 can be made by the same method of pressing or other as conventional ones. Furthermore, the folding lines may be perforated lines or Thomson-cut lines cut to the depth of half of the thickness of the sheet.

In the packaging box of the above-described constitution, first the sheet having the contour as shown in FIG. 5 is bent nearly squarely along the folding lines 16 to shape a rectangular parallelepiped, while the part of the point 0 is pressed inward of the box along the folding lines 17 during this folding process so that this point 0 will come inside of the rectangular parallelepiped, thus making the packaging box 1 having the concaved sections 2 as shown in FIGS. 1 to 4. The folding lines of these concaved sections 2 are so provided as to connect three ridgelines.

Then, the worker opens the top face section 4 and puts coils 100 of welding wire in the box. These coils of welding wire are placed in the box with their axial center vertically set in relation to the top and bottom faces of the packaging box. In this case, since the welding wire is wound into a form of coil, the concaved sections 2 at the four bottom corners of the box will not interfere with the coils of welding wire, notwithstanding that these concaved sections 2 protrude inward of the box.

Next, the pasting margin sections 7 to 9 and 12 to 15 are folded down to attach to a counter side, thus completing making the packaging box containing the coils of welding wire. When making the packaging box, the box is first partly made by bonding a part other than the top face section 4 to be bonded, and then, after insertion of the coils of welding wire, the top face section 4 may be bonded to seal the coils in the box.

At the same time the present invention is capable of easily shaping the concaved section which has been bonded with hotmelt or otherwise after folding by the same method as a conventional one, and then by manually giving a light push to this section with fingers along the folding lines preprovided at four corners or by automatically giving a light push to the protruding member. This may be done via a conventional packaging process: i.e., manual, semiautomatic or fully automatic process.

The packaging box 1 containing the welding wire by the above-described packaging method has the concaved sections 2 at four corners, and therefore there exists a clearance between these concaved sections 2 and the floor when the box is placed o the floor of a factory or a warehouse. The worker lifts the box 1 with the hands reaching the concaved sections 2 and the fingers inserted in the concaved sections 2 to grip the box. Since the box 1 has the concaved sections 2 at corners, it is unnecessary for the worker to tilt the box 1 to provide a clearance large enough to insert the hands therein. The worker just inserts the hands into the concaved sections 2 and can easily lift the box 1. As the worker can carry the box 1 with his fingers in these concaved sections 2, there will not occur such a hazard that the box slips off the hands and down. Therefore, the present embodiment presents a packaging box which can be carried with improved safety and portability. The concaved section 2 is not formed by cutting off the corner, but is provided by depressing the corner into the box, and therefore has high strength.

It is to be understood that the present invention is not limited only to the embodiment described above, but variations and modifications can be effected.

Figure 6:
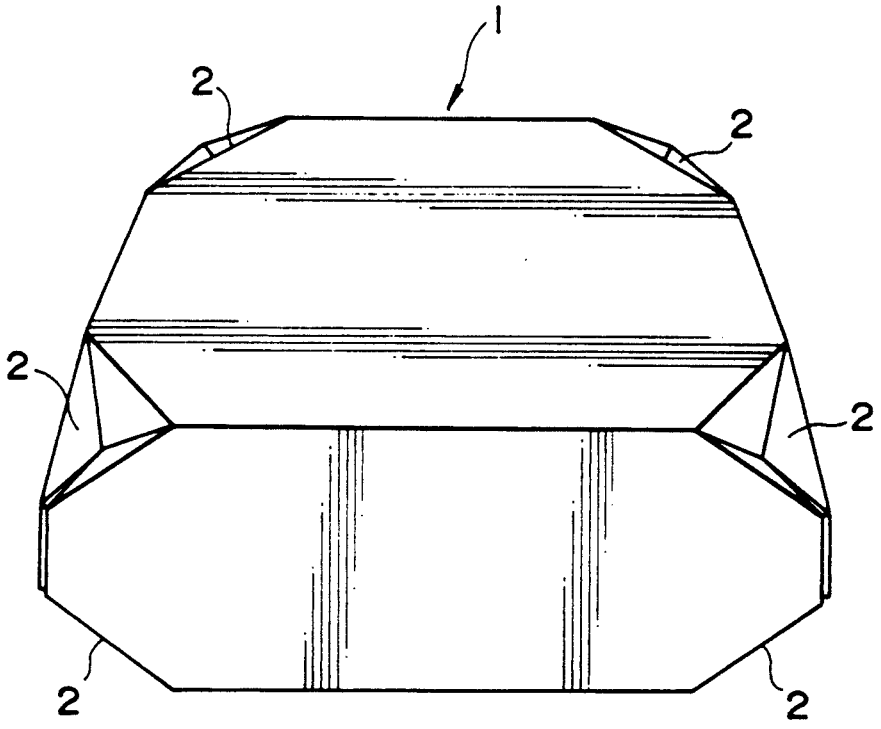
FIG. 6 is a perspective top view of another embodiment of the packaging box according to the present invention.
Figure 7:
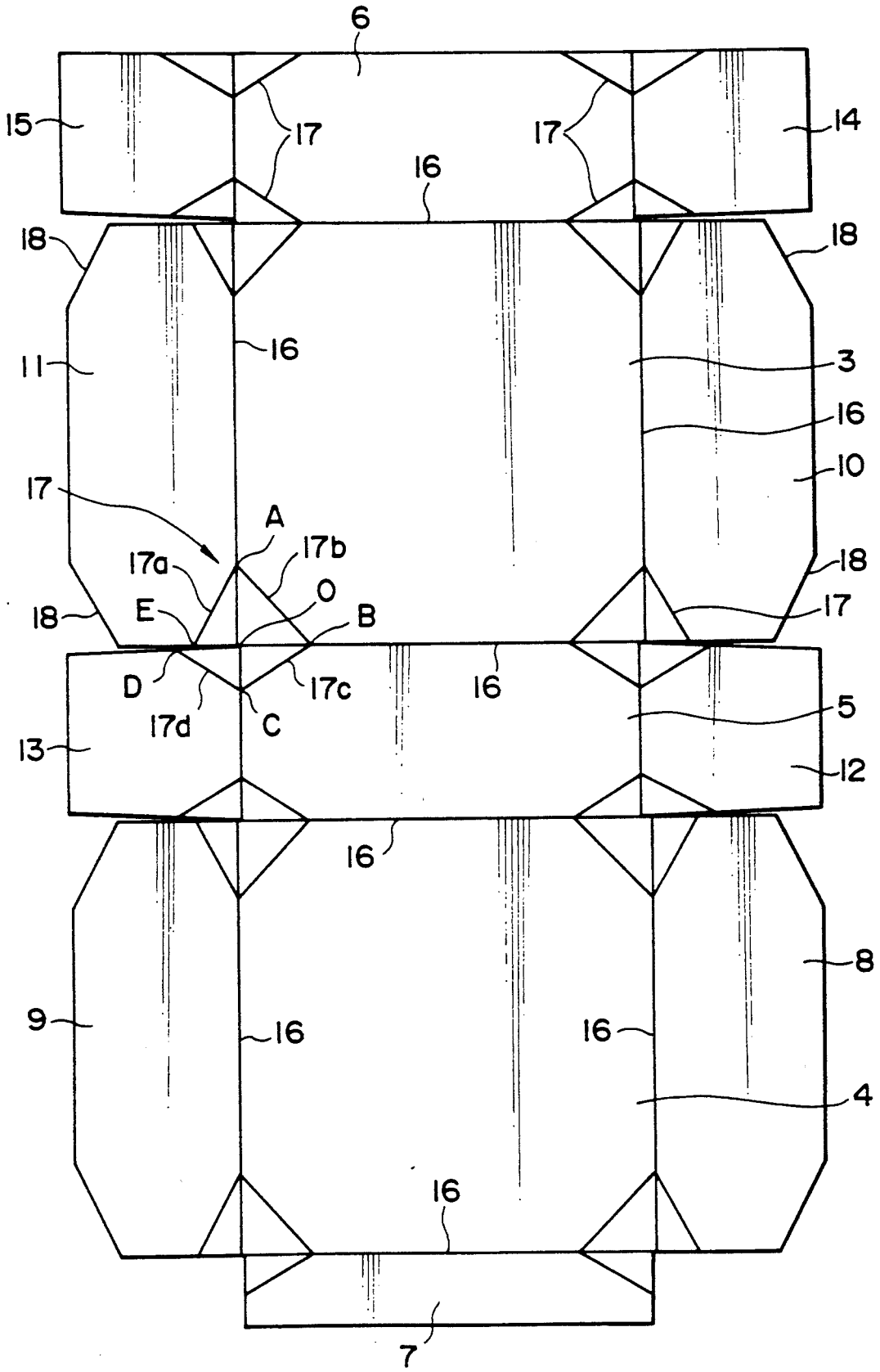
FIG. 7 is a developed view of the same.

For example, the concaved sections 2 may be provided at eight corners of the top and bottom faces of a rectangular-parallelepiped box as shown in FIG. 6. A developed view of this packaging box is shown in FIG. 7. As illustrated, the concaved sections 2 may be made at arbitrary ones of the eight corners.

However, as shown in FIG. 7, the sides 10 and 11 are cut into triangles in accordance with the shape of edges of the adjacent concaved sections 2. The cut edge 18 is in parallel with the edge of the concaved section 2, when the box is folded, but is positioned slightly to inwardly of the side face from the line which matches with this edge. That is to say, the concaved section 2 forms a larger triangle than the triangular section cut off along the lines matching with the edges of the concaved section 2. Also, there are provided folding lines 16 for folding these corners nearly squarely.

Figure 8:
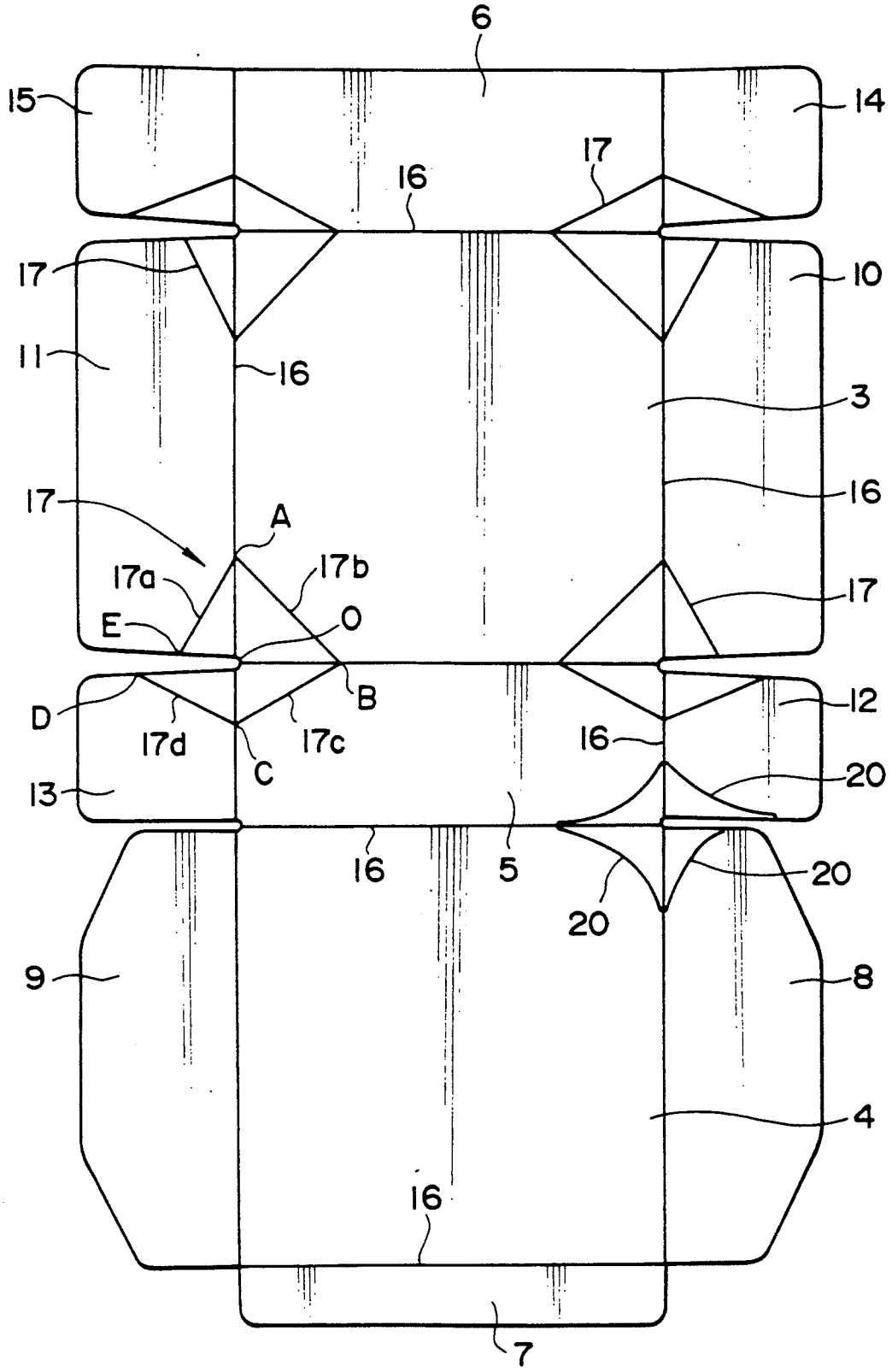
FIG. 8 is a developed view of another embodiment of the packaging box according to the present invention.
Figure 9:
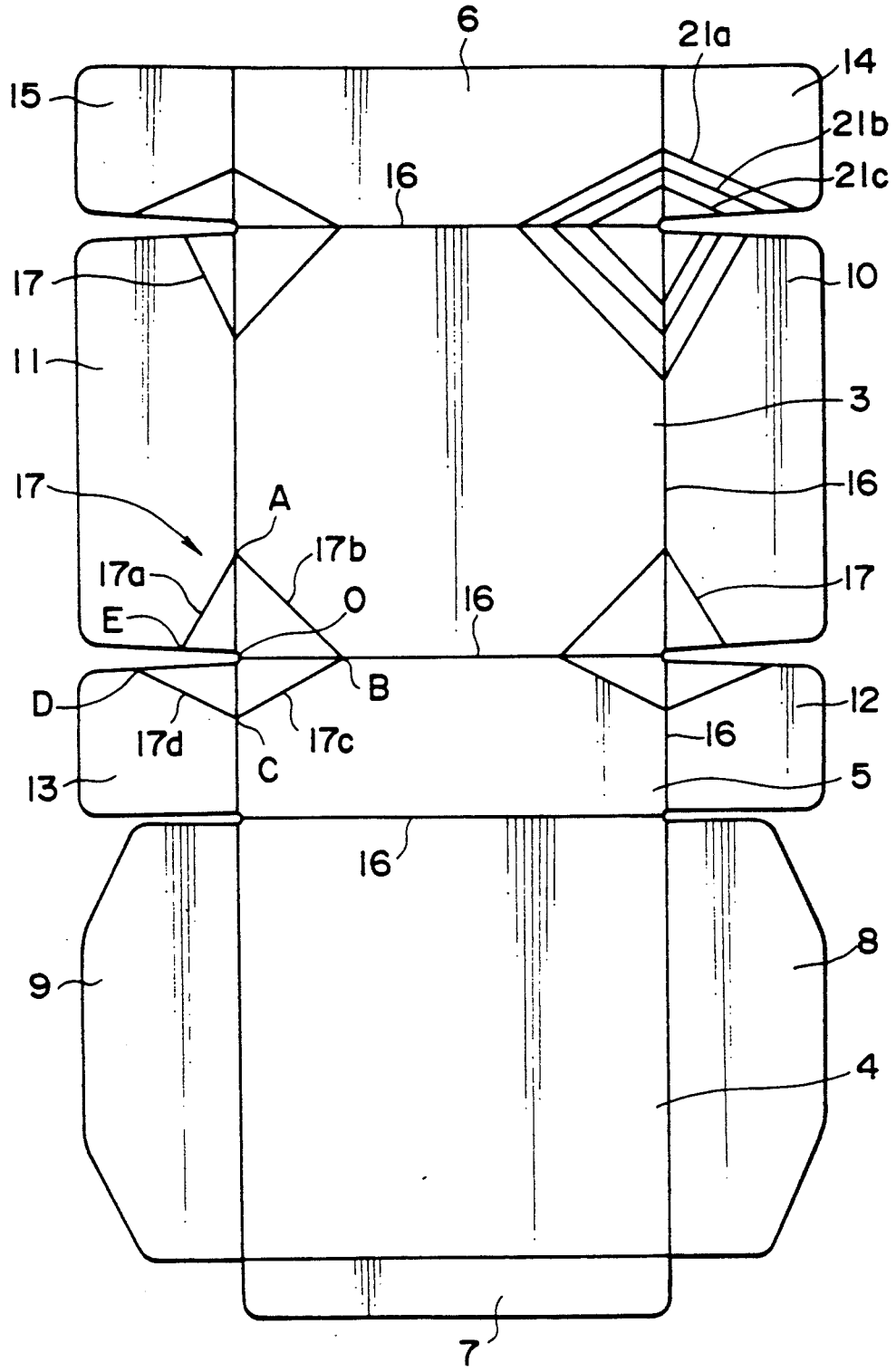
FIG. 9 is a developed view of further another embodiment of the packaging box according to the present invention.

The folding lines in the examples shown in FIGS. 5 to 7 are straight lines, but may be curved ones 20 as shown in FIG. 8. Furthermore, as shown FIG. 9, the box may be provided with three sets of folding lines 21*a*, 21*b*, and 21*c*, from which necessary folding lines may be selected in accordance with the size of objects to be contained in the box, thereby making concaved sections of a desired size. The size of the concaved sections to be made can be selected after the decision of objects to be put in the box. It is, therefore, possible to obtain a packaging box having wide application to goods to be contained.

Furthermore, the present invention has the advantage that the container may be preprovided with concaved sections as previously stated, and the concaved sections may be provided when needed after the formation of the container.

Furthermore, the packaging box of the present invention is usable not only for holding wires for welding but also for holding various kinds of goods. That is, if it is possible to provide the box with the above-described concaved sections 2 in at least two of its four corners, the box is usable for holding cylindrical or undefined-shape goods, but not such rectangular-parallel piped goods as chemicals, confectionery, powders, etc. The box of the present invention is usable for holding objects of rectangular parallelpiped if these objects are protected with shock-absorbing styro-foam placed around to provide a clearance at least at the corners between the inner surface of the box and the object. The objects may be electrical products such as audio-video equipment, e.g. amplifiers, video cassette recorders, speakers, etc., personal computers, etc.

Figure 10:
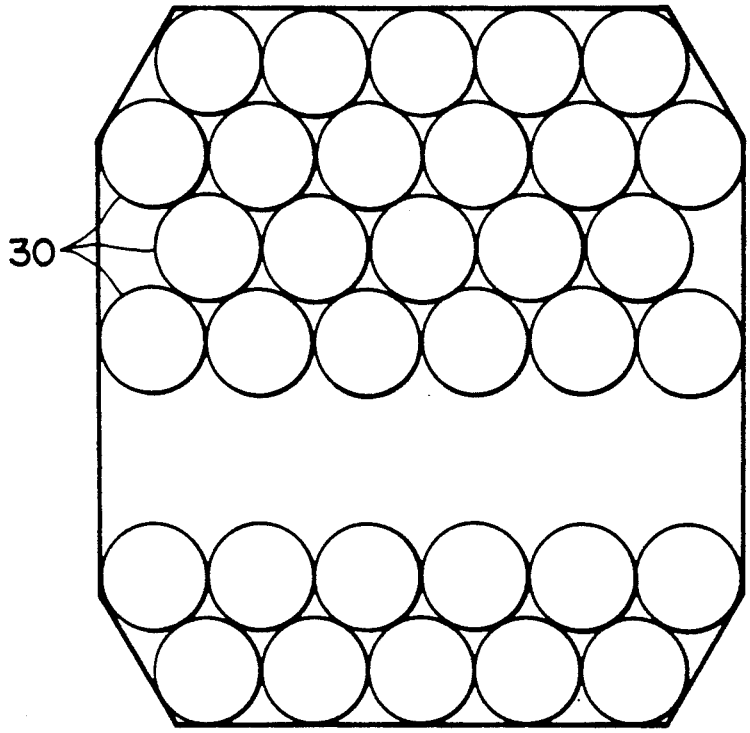
FIG. 10 shows the arrangement of contents in a variation of the present embodiment of the packaging box.
Figure 11:
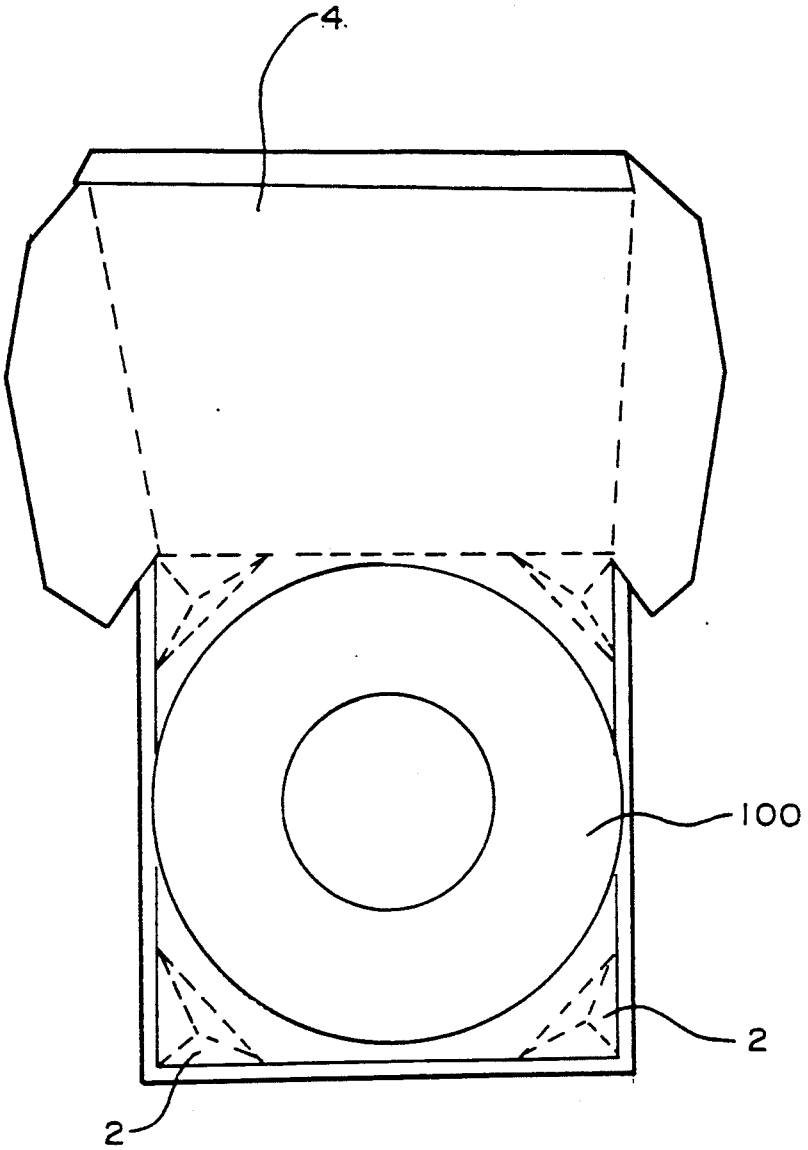
FIG. 11 shows a coil in a box according to the invention.

In a packaging box, cans of canned beer are packaged in a checkered arrangement. When these cans 30 are placed close to one another in the box according to the invention as shown in the arrangement plan in FIG. 10, there will be formed a space at the four corners. That is, the packaging box of the present invention becomes applicable to the packaging of canned beer or the like simply by changing the way of arrangement of cans.

The present invention has been described in detail with particular reference to a preferred embodiment thereof but it will be understood that variations and modifications can be effected within the spirit and scope of the invention.

What is claimed is:

1. A packaging box substantially comprising six sides including a top face and a bottom face, having at least one concaved section provided at a corner where three ridgelines meet, said concaved section being formed by folding said corner inward along three folding lines interconnecting said ridgelines.

2. A packaging box as claimed in claim 1, wherein said concaved section comprises more than one concaved section, a respective one of said concaved sections being provided in each of at least two corners of either one of the top face and the bottom face of the said packaging box.

3. A packaging box as claimed in claim 2, wherein one said concaved section is provided in each of at least two corners of said top face of said packaging box and in each of at least two corners of said bottom face of said packaging box.

4. A packaging box substantially comprising six sides including a top face and a bottom face, having three folding lines forming interconnecting ridgelines in each of at least one corner where said three folding lines meet, the sides forming said at last one corner being capable of being folded inward in said corner along said folding lines.

5. A packaging box as claimed in claim 4, wherein said at least one corner comprises at lest two corners of either one of the top face and the bottom face of said packaging box.

6. A packaging box as claimed in claim 4, wherein said at least one corner comprises at least two corners of said top face of said packaging box and in each of at least two corners of said bottom face of said packaging box.

7. A sheet for a packaging box, said box substantially comprising six sides including a top face and a bottom face, said sheet having folding lines for forming a concaved section from three of the sides around at least one of six corner sections of said packaging box upon being assembled, said three sides being located concave to a single plane and being interconnected by three ridgelnes for forming said at least one corner section.

8. A sheet for packaging box as claimed in claim 7, wherein said folding lines form plural concaved sections and wherein said folding lines for forming plural concaved sections are formed on ones of said sides including either one of faces that become the top face or the bottom face of said packaging box.

9. A sheet for packaging box as claimed in claim 7, wherein said folding lines form plural concaved sections and wherein said folding lines for forming plural concaved sections are formed on ones of said sides including faces that become said top and bottom faces of said packaging box.

10. A packaging box as claimed in claim 1, wherein a wire for welding is coiled into a coil on a spool and put in said box with an axial center of the coil directed at right angles with said top and bottom faces of said box.

* * * * *

UNITED STATES PATENT AND TRADEMARK OFFICE

CERTIFICATE OF CORRECTION

PATENT NO. : 5,314,111

DATED : May 24, 1994

INVENTOR(S) : Yutaka TAKAKU, et al.

It is certified that error appears in the above-indentified patent and that said Letters Patent is hereby corrected as shown below:

On the title page, Item [30], the Foreign Application Priority Data should read as follows:

--[30] Foreign Application Priority Data

| | | | | |
|---|---|---|---|---|
| Sep. 28, 1991 | [JP] | Japan | ..... | 3-277140 |
| Jan. 21, 1992 | [JP] | Japan | ..... | 4-008768 |
| Mar. 30, 1992 | [JP] | Japan | ..... | 4-074751 |
| Mar. 30, 1992 | [JP] | Japan | ..... | 4-074758 |
| Apr. 22, 1992 | [JP] | Japan | ..... | 4-103228 |
| May 15, 1992 | [JP] | Japan | ..... | 4-123886 |
| May 15, 1992 | [JP] | Japan | ..... | 4-123887-- |

Signed and Sealed this

Twenty-third Day of August, 1994

*Attest:*

Bruce Lehman

BRUCE LEHMAN

*Attesting Officer*

*Commissioner of Patents and Trademarks*